US010794307B2

(12) United States Patent
Reynolds et al.

(10) Patent No.: US 10,794,307 B2
(45) Date of Patent: Oct. 6, 2020

(54) CYLINDER DEACTIVATION FOR CATALYST DRYING

(71) Applicant: Cummins Inc., Columbus, IN (US)

(72) Inventors: David Joseph Reynolds, Memphis, IN (US); David A. Brush, Columbus, IN (US)

(73) Assignee: Cummins Inc., Columbus, IN (US)

( * ) Notice: Subject to any disclaimer, the term of this patent is extended or adjusted under 35 U.S.C. 154(b) by 209 days.

(21) Appl. No.: 15/125,436

(22) PCT Filed: Apr. 24, 2014

(86) PCT No.: PCT/US2014/035322
§ 371 (c)(1),
(2) Date: Sep. 12, 2016

(87) PCT Pub. No.: WO2015/163892
PCT Pub. Date: Oct. 29, 2015

(65) Prior Publication Data

US 2017/0074185 A1 Mar. 16, 2017

(51) Int. Cl.
*F02D 41/00* (2006.01)
*F02D 41/14* (2006.01)

(52) U.S. Cl.
CPC ..... *F02D 41/0087* (2013.01); *F02D 41/0082* (2013.01); *F02D 41/1446* (2013.01); *F02D 41/1459* (2013.01); *F02D 2041/1472* (2013.01); *F02D 2200/08* (2013.01)

(58) Field of Classification Search
CPC ..... F02D 41/0082; F02D 41/0087; F02D 41/1446; F02D 2041/1472; F02D 2200/08; F02D 41/1459
See application file for complete search history.

(56) References Cited

U.S. PATENT DOCUMENTS 5,315,824 A * 5/1994 Takeshima ..... F01N 3/0835 422/169
5,657,625 A * 8/1997 Koga ..... B01D 53/9495 60/274
6,119,452 A * 9/2000 Kinugasa ..... B01D 53/8696 123/443
6,164,065 A * 12/2000 Denari ..... B01D 53/9431 60/284

(Continued)

OTHER PUBLICATIONS

The International Search Report and Written Opinion issued in PCT application No. PCT/US2014/035322, dated Sep. 22, 2014.

*Primary Examiner* — Matthew T Largi
(74) *Attorney, Agent, or Firm* — Foley & Lardner LLP

(57) ABSTRACT

An engine control system and method of controlling an engine system are provided. The engine control system includes at least one sensor module configured to generate an exhaust condition signal based on a determined condition in an exhaust component and a cylinder bank control module communicatively coupled to the at least one sensor module. The cylinder bank control module is configured to cause transmission of a first bank control signal to cause a first bank of cylinders of an engine to deactivate at least in part in response to a determination based on the exhaust condition signal that a hydrocarbon mass quantity is above a pre-determined hydrocarbon mass quantity threshold.

18 Claims, 3 Drawing Sheets

(56) References Cited

U.S. PATENT DOCUMENTS

| | | | | |
|---|---|---|---|---|
| 6,360,713 | B1 * | 3/2002 | Kolmanovsky | F02D 17/02 123/295 |
| 6,389,806 | B1 | 5/2002 | Glugla et al. | |
| 6,550,240 | B2 * | 4/2003 | Kolmanovsky | F01N 3/0814 123/443 |
| 6,938,410 | B2 | 9/2005 | Glugla et al. | |
| 7,854,114 | B2 | 12/2010 | England | |
| 7,856,815 | B2 | 12/2010 | Demura et al. | |
| 8,156,736 | B2 * | 4/2012 | Mullins | F01N 3/0253 60/276 |
| 8,256,214 | B2 | 9/2012 | Rioli et al. | |
| 2002/0129597 | A1 * | 9/2002 | Glugla | F01N 3/2006 60/274 |
| 2005/0204727 | A1 * | 9/2005 | Lewis | F01L 9/04 60/285 |
| 2009/0031704 | A1 * | 2/2009 | Tanaka | F02D 41/0025 60/276 |
| 2010/0058741 | A1 * | 3/2010 | Toshioka | B01D 53/9495 60/286 |
| 2011/0265454 | A1 * | 11/2011 | Smith | F01N 3/0842 60/274 |
| 2012/0240553 | A1 * | 9/2012 | LaRose, Jr. | F01N 9/002 60/274 |
| 2015/0345407 | A1 * | 12/2015 | Glugla | F02D 17/02 123/403 |

* cited by examiner

CYLINDER DEACTIVATION FOR CATALYST DRYING

CROSS REFERENCE TO RELATED APPLICATIONS

The present application is a U.S. National Stage of PCT Patent Application No. PCT/US2014/035322, filed Apr. 24, 2014 and the contents of which are incorporated herein by reference in its entirety.

TECHNICAL FIELD

This disclosure relates to a cylinder deactivation system for an internal combustion engine.

BACKGROUND

Increasingly stringent emissions standards may be met by the use of after-treatment systems coupled to the exhaust stream of internal combustion engines. Such after-treatment systems help prevent and reduce harmful emissions being released to the atmosphere as by-products of combustion processes in systems such as diesel engines. Systems for treating harmful exhaust emissions often include a catalytic device and doser system that injects a fluid, such as a specific reductant into the exhaust stream to chemically reduce harmful emissions like oxides of nitrogen (NOx) on that catalyst. Over time, the catalytic devices have a build-up of water and hydrocarbons on the catalyst of the catalytic devices, especially when operating in duty cycles and climates where light loads and low catalyst temperatures are common. This hydrocarbon and water build up can lead to high temperature exotherms and white smoke emissions if not removed. At certain temperature levels and frequencies, the exotherms can damage components of the after-treatment system.

SUMMARY

Various embodiments provide an engine control system and methods of controlling an engine to release hydrocarbons and water from an after-treatment device coupled to the engine. In particular embodiments, an engine control system includes at least one sensor module configured to generate an exhaust condition signal based on a determined condition in an exhaust component and a cylinder bank control module communicatively coupled to the at least one sensor module. The cylinder bank control module is configured to cause transmission of a first bank control signal to cause a first bank of cylinders of an engine to deactivate at least in part in response to a determination based on the exhaust condition signal that a hydrocarbon mass quantity is above a pre-determined hydrocarbon mass quantity threshold. The hydrocarbon mass quantity is associated with an accumulation of hydrocarbons on the exhaust component.

In particular embodiments, the determined condition is at least one of a hydrocarbon mass quantity, an exhaust temperature, and an exhaust humidity level. The determined condition may be an operating time of the exhaust component. The cylinder bank control module is configured to cause transmission of a first bank control signal to cause a first bank of cylinder of an engine to deactivate at least in part in response to a determination that an engine power requirement is below a power threshold, in accordance with particular embodiments. The power threshold may correspond to a maximum power output by a second bank of cylinders of the engine. In particular embodiments, the sensor module is configured to calculate the hydrocarbon mass quantity. In particular embodiments, the sensor module is configured to detect the hydrocarbon mass quantity. The cylinder bank control module may be coupled to a fuel control system. The engine control system may include a timer configured to measure a cylinder deactivation time. In particular embodiments, the engine control system includes a purge module configured to determine the amount of hydrocarbon purged from the engine after-treatment device based at least on part on the cylinder deactivation time. The cylinder bank control module may be coupled to an engine control module.

Various embodiments provide an engine assembly that includes an internal combustion engine including a first bank of cylinders and a second bank of cylinders. The engine assembly also includes a first engine after-treatment device coupled to the first bank of cylinders of the internal combustion engine and a second engine after-treatment device coupled to the second bank of cylinders of the internal combustion engine. The engine assembly further includes at least one sensor module coupled to the first after-treatment device and the second after-treatment device. The at least one sensor module is configured to determine a first exhaust condition for the first engine after-treatment device and a second exhaust condition for the second engine after-treatment device. The at least one sensor module is further configured to generate a first exhaust condition signal and a second exhaust condition signal. The engine assembly also includes a cylinder bank control module communicatively coupled to the at least one sensor module. The cylinder bank control module is configured to cause transmission of a bank control signal to cause at least one of the first bank of cylinders and the second bank of cylinders to deactivate at least in part in response to a determination that one of the first exhaust condition signal and the second exhaust condition signal is above a pre-determined exhaust condition threshold.

In particular embodiments, the first exhaust condition and the second exhaust condition are at least one of a hydrocarbon mass quantity, an exhaust temperature, and an exhaust humidity level. The first exhaust condition is an operating time of the first engine after-treatment device and the second exhaust condition is an operating time of the second engine after-treatment device, in accordance with particular embodiments. The cylinder bank control module may be configured to cause transmission of the bank control signal to cause at least one of the first bank of cylinders and the second bank of cylinders to deactivate at least in part in response to a determination that an engine power requirement is below a power threshold. In particular embodiments, the power threshold corresponds to a maximum power output by one of the first bank of cylinders and the second bank of cylinders. The at least one sensor module may be configured to calculate the hydrocarbon mass quantity. The engine the at least one sensor module may be configured to detect the hydrocarbon mass quantity. In particular embodiments the cylinder bank control module is coupled to a fuel control system. The purge module is configured to determine the amount of hydrocarbon purged from at least one of the first engine after-treatment device and the second engine after-treatment device, in accordance with particular embodiments. The cylinder bank control module may be coupled to an engine control module.

Other various embodiments provide a method of controlling an engine system. The method includes determining a hydrocarbon mass quantity for an engine after-treatment device. The method also includes generating a hydrocarbon mass quantity signal based on the determined hydrocarbon mass quantity. The method further includes causing deactivation of one of a first bank of cylinders and a second bank of cylinders of an internal combustion engine cylinder bank in response to a determination that the hydrocarbon mass quantity signal is above a pre-determined hydrocarbon mass quantity threshold.

In particular embodiments, the method includes determining an operating time of the engine after-treatment device. Causing deactivation of one of the first bank of cylinders and the second bank of cylinders of the internal combustion engine is at least in part in response to a determination that an engine power requirement is below a power threshold in accordance with particular embodiments. The power threshold may correspond to a maximum power output by one of the first bank of cylinders and the second bank of cylinders. In particular embodiments, the hydrocarbon mass quantity for the engine after-treatment device is calculated by at least one sensor module. The hydrocarbon mass quantity for the engine after-treatment device is detected by at least one sensor module in accordance with particular embodiments. Causing deactivation of one of the first bank of cylinders and the second bank of cylinders may include communication between the cylinder bank control module and a fuel control system of the internal combustion engine. The method may include measuring a cylinder deactivation time of one of the first bank of cylinders and the second bank of cylinders deactivated. In particular embodiments, the method includes determining the amount of hydrocarbon purged from the engine after-treatment device based at least on part on the cylinder deactivation time.

The inventors have appreciated that after-treatment systems may be effectively and efficiently purged of hydrocarbons and water via passive systems that bolster fuel economy of the engine rather than detract from fuel economy. It should be appreciated that all combinations of the foregoing concepts and additional concepts discussed in greater detail below (provided such concepts are not mutually inconsistent) are contemplated as being part of the inventive subject matter disclosed herein. In particular, all combinations of claimed subject matter appearing at the end of this disclosure are contemplated as being part of the inventive subject matter disclosed herein. It should also be appreciated that terminology explicitly employed herein that also may appear in any disclosure incorporated by reference should be accorded a meaning most consistent with the particular concepts disclosed herein.

BRIEF DESCRIPTION OF THE DRAWINGS

The skilled artisan will understand that the drawings primarily are for illustrative purposes and are not intended to limit the scope of the subject matter described herein. The drawings are not necessarily to scale; in some instances, various aspects of the subject matter disclosed herein may be shown exaggerated or enlarged in the drawings to facilitate an understanding of different features. In the drawings, like reference characters generally refer to like features (e.g., functionally similar and/or structurally similar elements).

The features and advantages of the inventive concepts disclosed herein will become more apparent from the detailed description set forth below when taken in conjunction with the drawings.

DETAILED DESCRIPTION

Following below are more detailed descriptions of various concepts related to, and embodiments of, inventive systems and methods of controlling an engine system. It should be appreciated that various concepts introduced above and discussed in greater detail below may be implemented in any of numerous ways, as the disclosed concepts are not limited to any particular manner of implementation. Examples of specific implementations and applications are provided primarily for illustrative purposes.

Particular embodiments may be implemented with an engine such as a diesel vee engine having dual banks of after-treatment systems and that has thermostatically controlled aftercooling. The engine is adapted for a bank of the cylinders to be cut-out or deactivated to dry out or evaporate the hydrocarbons and water on the non-firing bank. While the non-firing bank is deactivated, the non-firing bank will still flow air that is warmer than the ambient condition as a result of work being done on it by the power cylinders. The air may also be warmer as a result of flowing the air across a thermostatically controlled aftercooler. When the air from the non-firing bank passively (i.e. without the use of auxiliary air handling device, exhaust throttle, turbocharger, or other energy consuming device) flows across a wet after-treatment device, it evaporates wet hydrocarbons and water from the after-treatment device, which may dry the after-treatment device out in as little as a few minutes and, through alternating drying cycles on each leg of the vee, helps prevent excessive build up and purge the after-treatment device.

Figure 1:
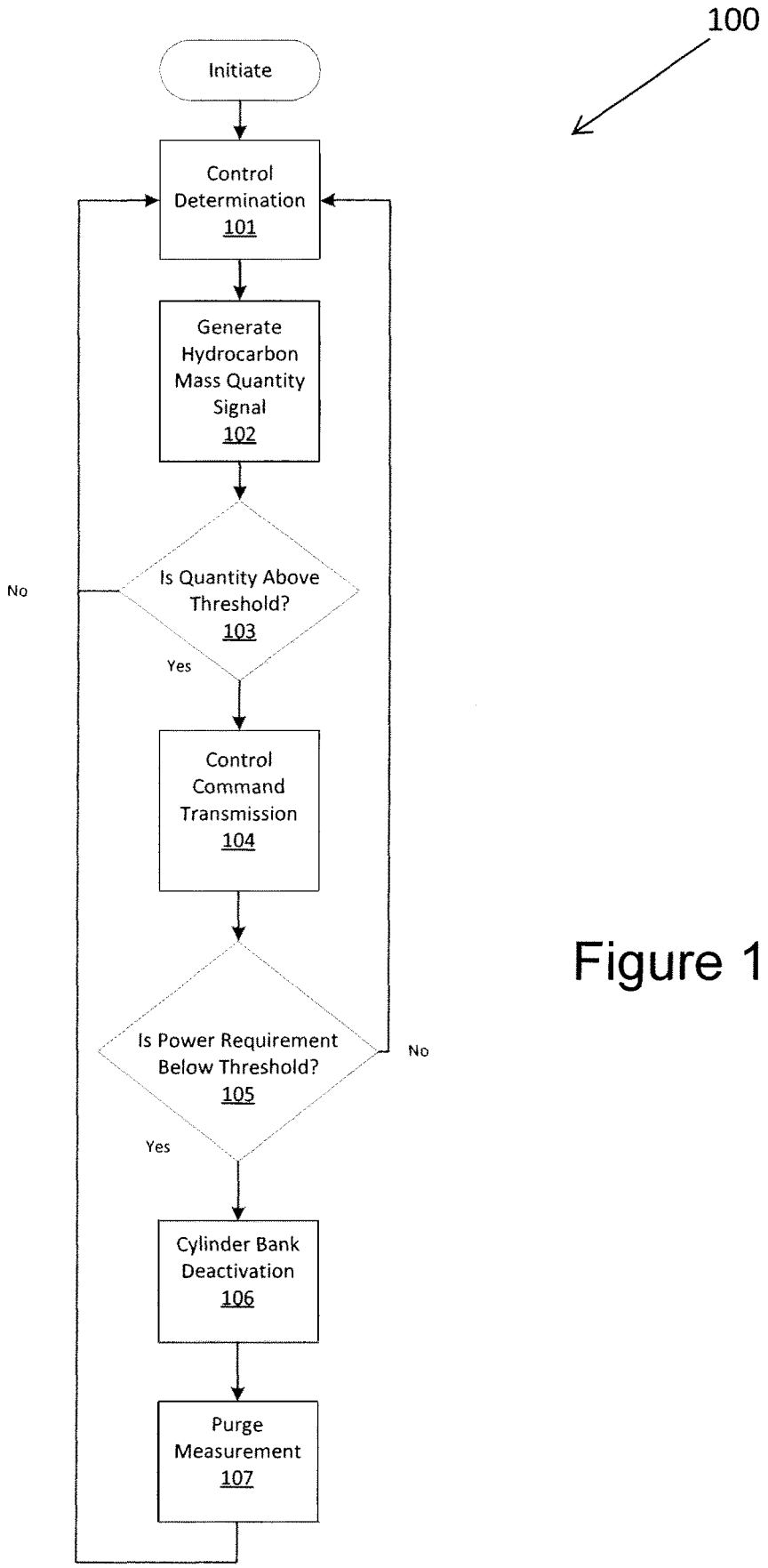
FIG. 1 is a flow chart demonstrating a process of controlling an engine in accordance with example embodiments.

FIG. 1 is a flow chart illustrating a process of controlling an engine in accordance with example embodiments. This process is represented generally at 100. The engine control process is represented at 100. This process may be initiated, for example, upon start-up, after a predetermined period of time of engine operation, or after initiation of a certain event, such as activation of a component of an after-treatment device. At 101, a control determination 101 is made to determine a hydrocarbon mass quantity for hydrocarbons deposited on a catalyst component of an engine after-treatment device or an exhaust condition directly or indirectly related to the accumulation of the hydrocarbons on the catalyst of the engine after-treatment device. The control determination 101 may be made via a virtual sensor that calculates the hydrocarbon mass quantity accumulated on an after-treatment system component based on operation of one or more engine components and/or after-treatment components. The control determination 101 may be made via a sensor disposed on one or more after-treatment system components to physically measure or detect the hydrocarbon mass quantity accumulated on an after-treatment system component. The engine control process 100 further includes generating a hydrocarbon mass quantity signal 102 based on the control determination 101.

The engine control process 100 also includes determining via analysis 103 whether the hydrocarbon mass quantity accumulated on the engine after-treatment system is greater than a pre-determined threshold and should be purged. In response to a determination at 103 that the hydrocarbon mass quantity accumulated on the engine after-treatment system is greater than a pre-determined threshold, a control command is generated and transmitted in process 104 to cause transmission of a bank control signal. The bank control signal deactivates a first bank of cylinders of the engine in response to a determination that the hydrocarbon mass quantity signal is above a predetermined hydrocarbon mass quantity threshold. In particular embodiments, the engine control process 100 may include further analysis, such as analysis process 105, where a determination of engine power requirements are made based on operating conditions of the engine. If, for example, the power requirements are below an amount that may be provided by a single bank of the internal combustion engine having multiple banks of cylinders, a cylinder bank may be deactivated in deactivation process 106. If the power requirements are greater than that which a single bank of cylinders (in a two bank engine, such a vee engine) or less than all banks of cylinders is capable of providing, the deactivation command may be overridden or not transmitted in accordance with example embodiments.

In particular embodiments, the engine control process 100 may also include a measurement process 107 where a timer is used to measure the deactivation time. Other parameters may be measured during the measurement process 107 such as air flow rate, air temperature and other parameters, which may be used to calculate an estimate of the amount of hydrocarbon purging has been achieved.

Figure 2:
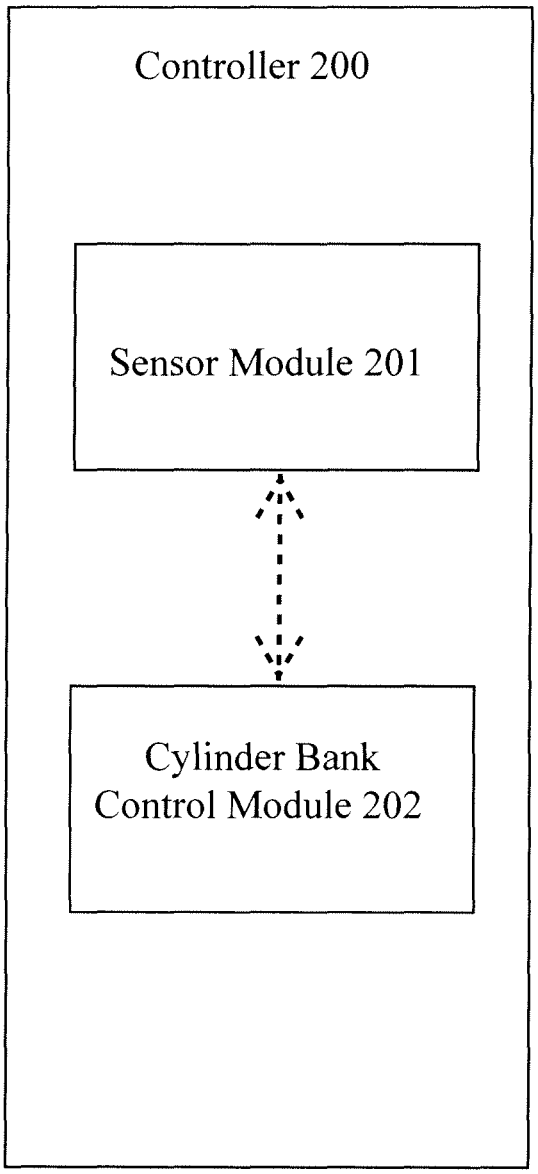
FIG. 2 is a representation of a control system for controlling an engine in accordance with example embodiments.

FIG. 2 is a representation of a control system for controlling an engine in accordance with example embodiments. The engine control system includes a controller 200 structured to perform certain operations to control deactivation of a bank of cylinders of the engine. In certain embodiments, the controller 200 forms a portion of a processing subsystem including one or more computing devices having memory, processing, and communication hardware. The controller 200 may be a single device or a distributed device, and the functions of the controller 200 may be performed by hardware and/or as computer instructions on a non-transient computer readable storage medium.

In certain embodiments, the controller 200 includes one or more modules structured to functionally execute the operations of the controller. As shown in FIG. 2, the controller 200 may include one or more sensor modules 201 configured to determine an exhaust condition signal based on a determined condition in an exhaust component related to a hydrocarbon mass quantity for an engine after-treatment device. The one or more sensor modules may be further configured to generate an exhaust condition signal, such as a hydrocarbon mass quantity signal. In particular embodiments, the one or more sensor modules 201 may be configured to determine an exhaust condition, including, but not limited to, a quantity of hydrocarbon mass accumulated on the engine after-treatment system, an exhaust temperature, an exhaust humidity level, and an operating time of an exhaust component. In certain embodiments, the controller 200 also includes a cylinder bank control module 202 communicatively coupled to the at least one sensor module. The cylinder bank control module 202 is configured to cause transmission of a first bank control signal to cause a first bank of cylinders of an engine to deactivate at least in part in response to a determination based on the exhaust condition signal that the hydrocarbon mass quantity signal is above a pre-determined hydrocarbon mass quantity threshold.

The description herein including modules emphasizes the structural independence of the aspects of the controller, and illustrates one grouping of operations and responsibilities of the controller. Other groupings that execute similar overall operations are understood within the scope of the present application. Modules may be implemented in hardware and/or as computer instructions on a non-transient computer readable storage medium, and modules may be distributed across various hardware or computer based components. More specific descriptions of certain embodiments of controller operations are included in the section referencing FIG. 1.

Example and non-limiting module implementation elements include sensors providing any value determined herein, sensors providing any value that is a precursor to a value determined herein, datalink and/or network hardware including communication chips, oscillating crystals, communication links, cables, twisted pair wiring, coaxial wiring, shielded wiring, transmitters, receivers, and/or transceivers, logic circuits, hard-wired logic circuits, reconfigurable logic circuits in a particular non-transient state configured according to the module specification, any actuator including at least an electrical, hydraulic, or pneumatic actuator, a solenoid, an op-amp, analog control elements (springs, filters, integrators, adders, dividers, gain elements), and/or digital control elements.

Figure 3:
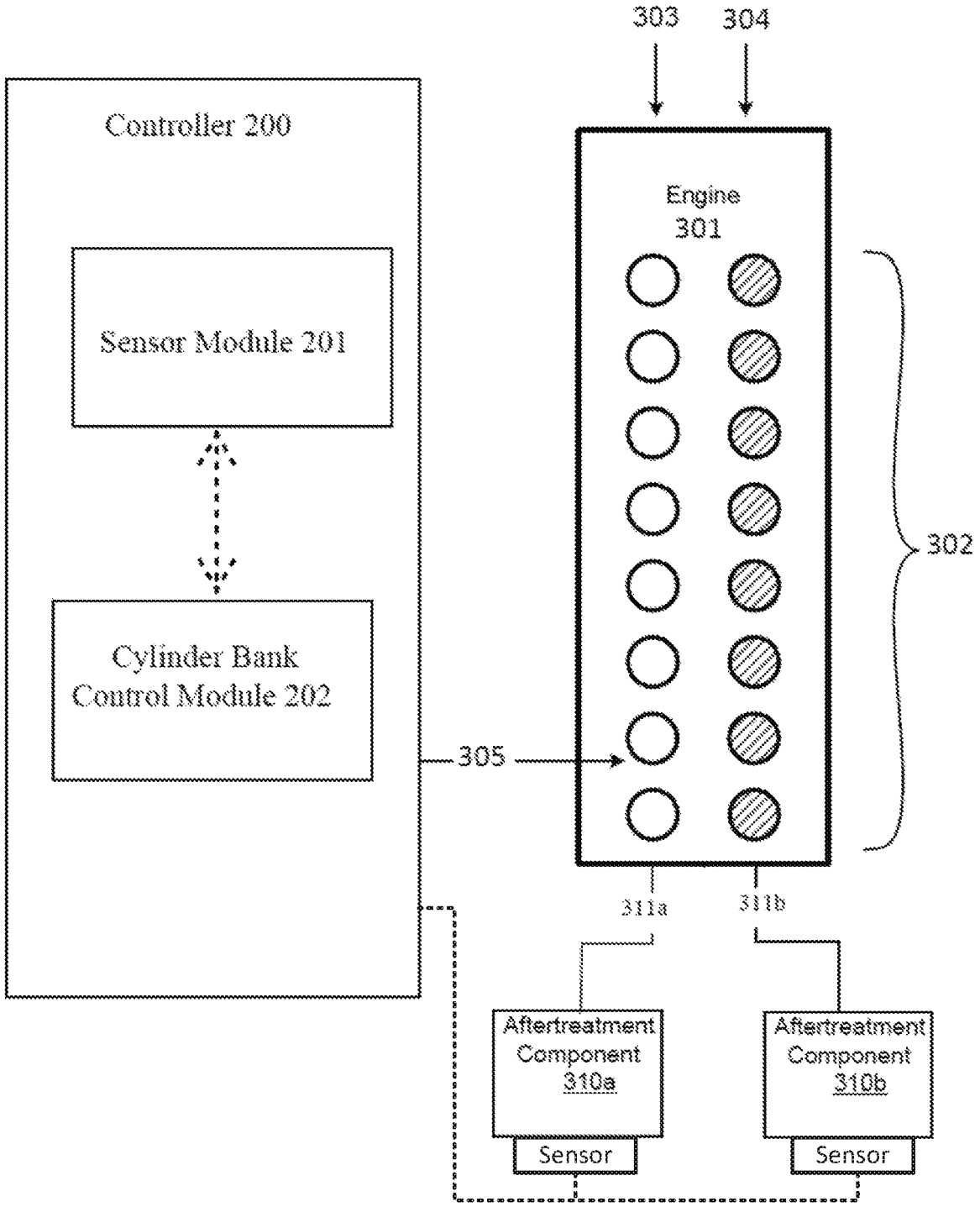
FIG. 3 is a representation an engine assembly coupled to a control system in accordance with example embodiments.

FIG. 3 illustrates an engine assembly coupled to a control system in accordance with example embodiments. The engine 301 depicted in FIG. 3 is a V-16 engine and is shown with a bank 303 of the cylinders 302 activated and with another bank 304 of the cylinders 302 deactivated. The engine 301 includes an after-treatment system component 310*a* coupled to bank 303 via exhaust line 311*a* and an after-treatment system component 310*b* coupled to bank 304 via exhaust line 311*b*. In response to a determination by the cylinder bank control module 202 that the hydrocarbon mass quantity signal is above a pre-determined hydrocarbon mass quantity threshold, based on the one or more sensor modules 201 determining a quantity of hydrocarbon mass (or a value associated with the quantity of hydrocarbon mass) accumulated on one of the engine after-treatment system components 310*a* and 310*b* is above a pre-determined hydrocarbon mass quantity, the controller 200 transmits a cylinder deactivation command 305 to one of banks 303 and bank 304. The bank of cylinders deactivated corresponds to the bank coupled to the engine after-treatment system having a quantity of hydrocarbon mass accumulation, or value associated therewith, above the pre-determined quantity as determined by sensor modules 201. In particular embodiments, the sensor modules 201 may be coupled to the after-treatment system components 310*a* and 310*b*.

The cylinder deactivation command 305 may indicate if and/or when cylinder deactivation (and subsequent re-activation) should take place. In one embodiment, the cylinder deactivation command 305 may include a valve actuation commands that alters the opening and closing of a fuel valve or the opening and closing of the intake and exhaust valves in an engine. In particular embodiments, the cylinder deactivation command 305 may include other actuation instructions, such as altering the pushrod and/or camshaft dynamics, in order to prevent fuel flow into the deactivated cylinders 304. Additionally, the cylinder deactivation command 305 may also include actuation instructions relating to the still-active cylinders 303 as well. For example, in order to maintain the power supply, the cylinder deactivation command 305 may call for an increase in fuel to be injected into the still active cylinders 303 or for the RPM rate to increase. Further, other parameters may also be adjusted, such as injection timing, and fuel injection pressure. In one embodiment, the amount of fuel injected into the active cylinders 303 is double what was originally being supplied in order to meet the power demand/load placed on the engine. It is contemplated that other systems and configurations may be implemented in order to effectively deactivate a portion of the cylinders. In particular embodiments, the portion of the cylinders 302 that is deactivated is 50%.

It is important to note that the constructions and arrangements of apparatuses or the components thereof as shown in the various exemplary embodiments are illustrative only. Although only a few embodiments have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter disclosed. For example, elements shown as integrally formed may be constructed of multiple parts or elements, the position of elements may be reversed or otherwise varied, and the nature or number of discrete elements or positions may be altered or varied. The order or sequence of any process or method steps may be varied or re-sequenced according to alternative embodiments. Other substitutions, modifications, changes and omissions may also be made in the design, operating conditions and arrangement of the various exemplary embodiments without departing from the scope of the present disclosure.

While various inventive embodiments have been described and illustrated herein, those of ordinary skill in the art will readily envision a variety of other mechanisms and/or structures for performing the function and/or obtaining the results and/or one or more of the advantages described herein, and each of such variations and/or modifications is deemed to be within the scope of the inventive embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the inventive teachings is/are used. Those skilled in the art will recognize, or be able to ascertain using no more than routine experimentation, many equivalents to the specific inventive embodiments described herein. It is, therefore, to be understood that the foregoing embodiments are presented by way of example only and that, within the scope of the appended claims and equivalents thereto, inventive embodiments may be practiced otherwise than as specifically described and claimed. Inventive embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the inventive scope of the present disclosure.

Also, the technology described herein may be embodied as a method, of which at least one example has been provided. The acts performed as part of the method may be ordered in any suitable way unless otherwise specifically noted. Accordingly, embodiments may be constructed in which acts are performed in an order different than illustrated, which may include performing some acts simultaneously, even though shown as sequential acts in illustrative embodiments.

All definitions, as defined and used herein, should be understood to control over dictionary definitions, definitions in documents incorporated by reference, and/or ordinary meanings of the defined terms.

The indefinite articles "a" and "an," as used herein in the specification and in the claims, unless clearly indicated to the contrary, should be understood to mean "at least one."

The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

In the claims, as well as in the specification above, all transitional phrases such as "comprising," "including," "carrying," "having," "containing," "involving," "holding," "composed of," and the like are to be understood to be open-ended, i.e., to mean including but not limited to.

The claims should not be read as limited to the described order or elements unless stated to that effect. It should be understood that various changes in form and detail may be made by one of ordinary skill in the art without departing from the spirit and scope of the appended claims. All embodiments that come within the spirit and scope of the following claims and equivalents thereto are claimed.

The invention claimed is:

1. An engine control system, comprising:

a sensor configured to measure a first unburned hydrocarbon mass quantity of unburned hydrocarbons accumulated on an exhaust after-treatment component; and a controller operably coupled to the sensor, the controller configured to:

generate an exhaust condition signal based on a determined condition in the exhaust after-treatment component, the determined condition comprising the first unburned hydrocarbon mass quantity of unburned hydrocarbons measured by the sensor and an exhaust gas humidity level, the exhaust after-treatment component coupled to a first bank of cylinders of an engine, cause transmission of a first bank control signal to cause the first bank of cylinders of the engine to deactivate at least in part based on: a) the exhaust gas humidity level, and b) in response to a determination based on the exhaust condition signal that the first unburned hydrocarbon mass quantity is above a pre-determined hydrocarbon mass quantity threshold, such that the deactivating of the first bank of cylinders causes evaporation of the unburned hydrocarbons accumulated on the exhaust after-treatment component; and estimate an amount of hydrocarbons that have been purged from the exhaust after-treatment component based at least on an air flow rate and an air temperature through the deactivated first bank of cylinders.

2. The engine control system of 1, wherein the determined condition also comprises an exhaust temperature.

3. The engine control system of 1, wherein the determined condition also comprises an operating time of the exhaust after-treatment component.

4. The engine control system of 1, wherein the controller is configured to cause transmission of the first bank control signal to cause the first bank of cylinders of the engine to deactivate further in response to a determination that an engine power requirement is below a power threshold.

5. The engine control system of 4, wherein the power threshold corresponds to a maximum power output by a second bank of cylinders of the engine.

6. The engine control system of 1, wherein the controller is coupled to a fuel control system.

7. The engine control system of 1, further comprising a timer configured to measure a cylinder deactivation time.

8. The engine control system of 7, wherein the controller is further configured to determine an amount of hydrocarbon purged from the exhaust after-treatment component based at least on part on the cylinder deactivation time.

9. An engine assembly comprising:

an internal combustion engine including a first bank of cylinders and a second bank of cylinders;

a first after-treatment device coupled to the first bank of cylinders of the internal combustion engine;

a second after-treatment device coupled to the second bank of cylinders of the internal combustion engine;

a first sensor configured to measure a first unburned hydrocarbon mass quantity of unburned hydrocarbons accumulated on the first after-treatment device;

a second sensor configured to measure a second unburned hydrocarbon mass quantity of unburned hydrocarbons accumulated on the second after-treatment device;

a controller coupled to the first sensor and the second sensor, the controller configured to:

determine a first exhaust condition for the first after-treatment device and a second exhaust condition for the second after-treatment device and further configured to generate a first exhaust condition signal and a second exhaust condition signal based on the respective first and second exhaust conditions, wherein the first exhaust condition comprises the first unburned hydrocarbon mass quantity of unburned hydrocarbons and an exhaust gas humidity level, and wherein the second exhaust condition relates to the second unburned hydrocarbon mass quantity of unburned hydrocarbons and the exhaust gas humidity level, cause transmission of a bank control signal to cause the first bank of cylinders to deactivate at least in part based on: a) the exhaust gas humidity level, and b) in response to a determination that the first exhaust condition signal indicates that the first unburned hydrocarbon mass quantity is above a pre-determined exhaust condition threshold, such that the deactivating of the first bank of cylinders causes evaporation of the unburned hydrocarbons accumulated on the first after-treatment device, and estimate an amount of hydrocarbons that have been purged from the first after-treatment device based at least on an air flow rate and an air temperature through the deactivated first bank of cylinders.

10. The engine assembly of claim 9, wherein at least one of the first exhaust condition and the second exhaust condition also includes an exhaust temperature.

11. The engine assembly of claim 9, wherein the first exhaust condition further comprises an operating time of the first after-treatment device and the second exhaust condition further comprises an operating time of the second after-treatment device.

12. The engine assembly of claim 9, wherein the controller is configured to cause transmission of the bank control signal to cause the first bank of cylinders to deactivate at least in part in response to a determination that an engine power requirement is below a power threshold.

13. The engine assembly of claim 12, wherein the power threshold corresponds to a maximum power output by the second bank of cylinders.

14. The engine assembly of claim 9, wherein the controller is coupled to a fuel control system.

15. A method of controlling an engine system, the method comprising:

measuring via a sensor, a hydrocarbon mass quantity for the engine after-treatment device coupled to a first bank of cylinders of an engine, the hydrocarbon mass quantity relating to a mass of unburned hydrocarbons accumulated on the engine after-treatment device;

determining an exhaust gas humidity level;

generating a hydrocarbon mass quantity signal based on the measured hydrocarbon mass quantity;

causing deactivation of the first bank of cylinders in response to a determination that the hydrocarbon mass quantity signal is above a pre-determined hydrocarbon mass quantity threshold and based on the exhaust gas humidity level; and estimating an amount of hydrocarbons that have been purged from the engine after-treatment device based at least on an air flow rate and an air temperature through the deactivated first bank of cylinders.

16. The method of controlling an engine system according to claim 15, further comprising determining an operating time of the engine after-treatment device.

17. The method of controlling an engine system according to claim 15, wherein causing deactivation of the first bank of cylinders is at least in part in response to a determination that an engine power requirement is below a power threshold.

18. The method of controlling an engine system according to claim 15, wherein the power threshold corresponds to a maximum power output by a second bank of cylinders of the engine.

* * * * *